US005343815A

United States Patent [19]

Dickinson

[11] Patent Number: 5,343,815

[45] Date of Patent: Sep. 6, 1994

[54] CONFECTIONARY BOARD

[75] Inventor: Thomas E. Dickinson, Liverpool, England

[73] Assignee: Dibro Limited, Liverpool, England

[21] Appl. No.: 907,683

[22] Filed: Jul. 2, 1992

[30] Foreign Application Priority Data

Jul. 5, 1991 [GB] United Kingdom ..... 9114592.0

[51] Int. Cl.[5] ..... B65D 19/16; A47B 57/00

[52] U.S. Cl. ..... 108/56.3; 108/101; D7/610

[58] Field of Search ..... 108/56.3, 53.5, 159, 108/101, 94, 156, 149, 111, 153; 99/645; 206/557; 248/188.4, 159, 165; 312/204, 285; 211/133, 128, 205, 196; 403/261, 197, 349; D7/610

[56] References Cited

U.S. PATENT DOCUMENTS

| | | | |
|---|---|---|---|
| 2,075,473 | 3/1937 | Schwary et al. | 108/56.3 |
| 2,178,166 | 10/1939 | Enstrom | D7/610 |
| 2,921,691 | 1/1960 | Dembinski | D7/610 |
| 3,407,758 | 10/1968 | Simkins | 99/645 |
| 3,690,610 | 9/1972 | Peirce | 248/159 |
| 3,814,032 | 6/1974 | McMains | 108/92 |
| 3,843,220 | 10/1974 | Snider | 108/101 |
| 4,069,772 | 1/1978 | Haapala | 108/94 |
| 4,101,232 | 7/1978 | Haapala | 403/261 |
| 5,165,637 | 11/1992 | Polley et al. | 108/101 |

*Primary Examiner*—Clifford D. Crowder
*Assistant Examiner*—Gloria Hale
*Attorney, Agent, or Firm*—Bernard L. Kleinke; Jerry R. Potts

[57] ABSTRACT

A confectionery board 10 constructed of plastics is of particular use for producing tiered cakes. The board is provided with a smooth or textured upper surface 12, a side surround 14 and a lower surface 20 which is provided with a plurality of mating members which enable the board to be accurately positioned and supported on a plurality of cake pillars 28 or like members. The mating members in one embodiment comprise a plurality of cross members 24 which run parallel to the side members 14 to provide the board with a plurality of cells 26 into which cake pillars 28 are located.

14 Claims, 2 Drawing Sheets

CONFECTIONARY BOARD

The present invention relates to a a confectionery board, cake base or drum, and more particularly, though not exclusively, to a cake base for tiered cakes such as wedding cakes.

Existing cake bases are manufactured in a number of forms. Solid constructions of compressed cardboards, chipboard or the like suffer a number of disadvantages and so the preferred bases are manufactured in cardboard using paper or aluminium foil for an overall finish. They comprise a base member, a wall member(s) and a top member; the board is held rigid by a plurality of irregularly orientated cardboard strips which are concertina folded and sandwiched on edge between the base and top member of the board.

Such boards suffer from a number of disadvantages: The materials used are not all suitable where food contact occurs and the process by which the boards are manufactured is labour intensive, involves the use of adhesives and involves man-handling, all of which give rise to a risk of food contamination.

The strength of the boards can be inconsistent, and due to the nature of their construction a number of other disadvantages are apparent. For example, when cutting a cake on these boards, small amounts of aluminium foil can be drawn into the cake being cut, and deeper cuts will impair the strength and load-bearing capability of the board. The fact that the supports are enclosed in an irregular manner within the board makes accurate location of cake pillar dowels difficult as the base layer has to be pierced. Furthermore, the piercing of the boards with dowels results in cardboard dust being produced, which dust may contaminate the cake.

It is one object of the present invention to provide a confectionery board which is an improvement over and above the board described.

According to one aspect of the present invention there is provided a confectionery board comprising a substantially planar face adapted to receive a cake, and opposed thereto a face which is provided with a plurality of first mating members thereon, which first mating members may engage directly or indirectly a cake pillar or like member to accurately locate said board thereto.

It is another aspect of the invention to provide a confectionery board consisting essentially of a substantially planar face adapted to receive a cake, and opposed thereto a face which is provided with a plurality of first mating members thereon, which mating members may engage directly or indirectly a cake pillar or like member to accurately locate said board thereto.

It is a further object of the present invention to provide a kit of parts for producing a wedding tier, said kit comprising a plurality of boards as hereinbefore described and at least one connecting member.

In one embodiment the connecting member comprises a central pillar having a shoulder protruding therefrom, which shoulder has means enabling it to locate with the one or more mating members of said board.

In another embodiment the connecting members comprise a plurality of dowels and a plurality of pillars having apertures passing therethrough.

In yet another embodiment the connecting members comprise pillars having integrally therewith a mating member provided thereon.

In one embodiment a confectionery board has a substantially planar face upon which a cake may lie and a face opposed thereto which comprises a regular lattice structure open at one end and closed at the other; the cells formed between respective cross members of the lattice are closed at one end and these cells serve to engage or locate a cake pillar or like member in position.

The pillar may have a projecting member formed thereon, in which case the pillar can be located directly into the cell, or it may locate indirectly by means of an intermediate member such as a cake pillar dowel.

Thus, to build a tiered cake, a first cake can be positioned on the planer face of a first board. A plurality of cake pillars may be positioned on the first cake and attached thereto by pushing a cake dowel therein. By leaving the dowels to project slightly above the pillars a second board can be located such that the cells on the underside of the second board engage the projecting dowel members, thereby locating the second board in position. Such a structure has the advantage that the accurate location of tiers can be achieved without the need to pierce the card, thereby avoiding the risk of contaminating the food.

Furthermore, by producing the board from plastics, for example polystyrene or polypropylene, a board can be produced from materials which comply with EEC directives concerning articles which come into contact with food. They are also stronger than existing boards, and can be easily cleaned and or sterilised.

In another embodiment the board's underside can be provided with a series of regularly spaced projections which could engage with a corresponding shaped aperture formed in the cake pillars or central tube-holding system.

The boards can be further provided with recessed side portions such that they can be lifted without a need to touch the upper face of the board, thereby making handling easier and more hygienic.

Preferably the centres of the boards are provided with an aperture, which aperture can serve the dual function of:

1. enabling a cake to be pushed off the board from underneath, and
2. serving as a means for fitting a central tube holding system thereto.

Once again the cells can be used to fixedly locate the central type holding system to the board. The centre aperture may be plugged with a cake spike to close it if required.

By injection moulding such boards it is possible to produce a board of one piece construction in any colour, shape or size. Thus boards of square, round, octagonal, or even heart shaped configuration in any colour, e.g. white, silver or gold, can be produced. The use of polystyrene or polypropylene means that the board can be made of a food-approved material, complying with all EEC directives. The boards can also be made in a single operation and immediately packed for hygiene in shrink wrap plastic. By producing the board in plastics, silver and gold finishes can be applied by vacuum coating processes which are again food approved. Since the mating surface can be seen it can be kept clean, and if necessary the product can be sterilised for re-use. The provision of a mating means, for example the provision of a matrix on the underside, enables easy location of cake pillar dowels to make tiers more secure.

The invention will now be described, by way of example only, with reference to the following drawings, in which.

Figure 1:
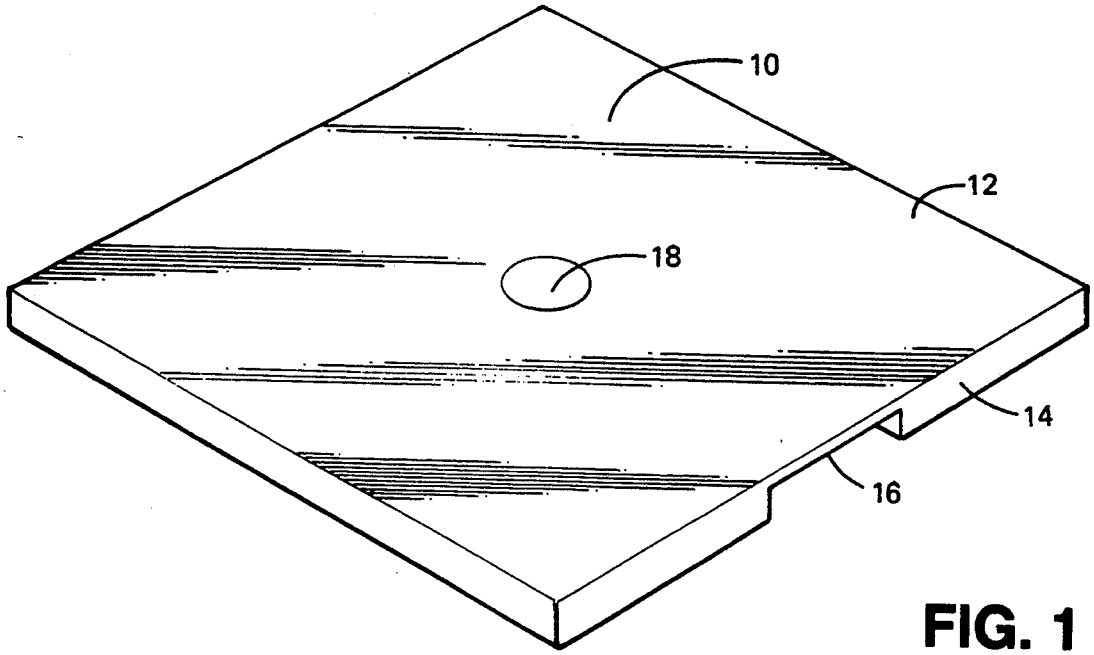
FIG. 1 is a perspective view from above of one embodiment of board.
Figure 2:
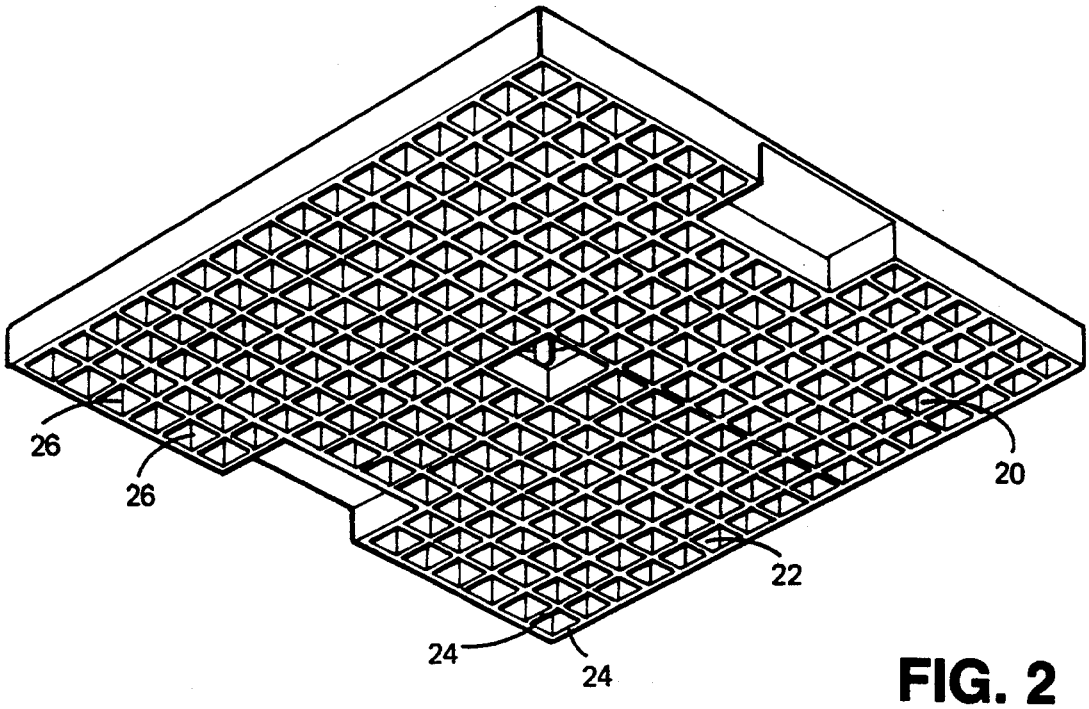
FIG. 2 is a perspective view from below of the embodiment illustrated in FIG. 1.
Figure 3:
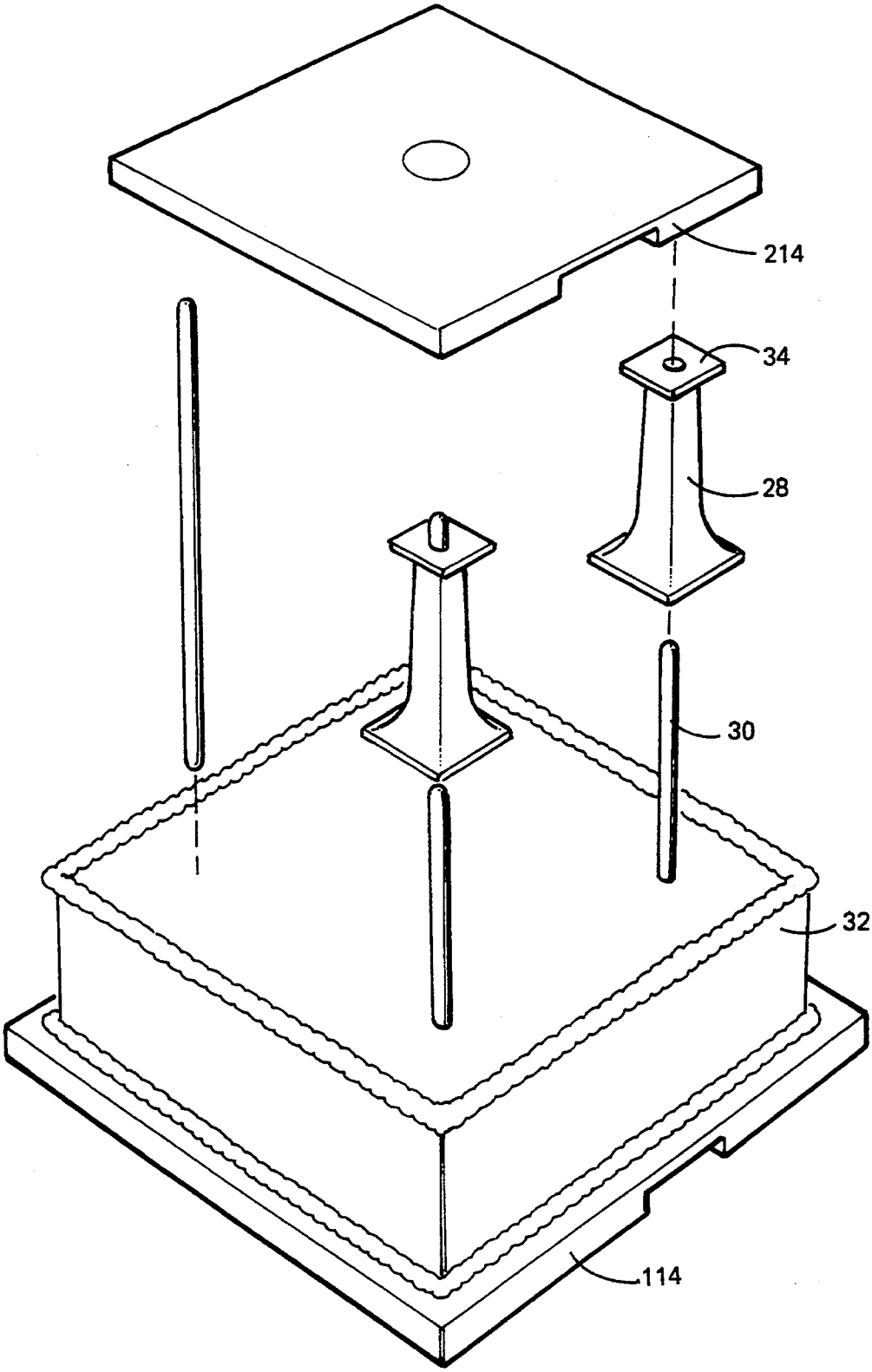
FIG. 3 shows the board illustrated in FIG. 1 in use.

Referring to the figures, a square confectionery board 10 constructed of polystyrene or polypropylene comprises a generally planar upper face 12 which may be smooth or textured.

The board is provided with a side surround 14 which is recessed along two sides to give rise to handle portions 16. The centre of the board 18 is provided with a cake spike which can be removed to leave an aperture which can accommodate a central tube holding system (not shown). Such a system can be used in place of support pillars and provides easier access to a cake which may be supported thereon.

The underside 20 of the board comprises a regular matrix 22. The matrix 22 comprises a plurality of cross members 24 which run parallel to the side members 14 to provide the underside 20 of the board with a plurality of cells or mating members 26, into which can be located a cake pillar 28 or an intermediate member such as a dowel 30.

To build up tiers a cake 32 is positioned on a first board 114 and a plurality of dowels 30 are inserted into position on the cake 32. Columns 28 are positioned over the dowels so that the dowel projects sufficiently above the top shoulder 34 of the column 28 to be able to engage in one of the cells 26 in the underside 20 of a second board 214 positioned there above. By repeating the procedure a tiered cake such as a wedding cake can be built up.

I claim:

1. In a kit for supporting a cake, including at least a pair of confectionery boards and removable cake pillar means for spacing the pair of confectionery boards from one another and for helping to position accurately the confectionery boards relative to one another and the cake therebetween, one of the boards comprising:

an upper surface and a lower surface connected by a side surround, said upper surface being a substantially planar face adapted to receive the cake, the board being composed of a food contaminate resistant material for reducing substantially risk of food contamination, and opposed thereto is said lower surface which has provided thereon a plurality of mating members which are closed to said planar face, which mating members serve to engage directly or indirectly said cake pillar means to enable said board and cake to be positioned accurately relative to one another, in which said mating members comprise a plurality of cells, each cell being defined by a plurality of cross members which extend from the side surround across said lower surface, thereby defining a regular lattice which is closed to said planar face.

2. In a kit, one of the confectionery boards as claimed in claim 1, in which said mating members comprise a plurality of cells, each cell being defined by a plurality of cross members which extend from the side surround across said lower surface, thereby defining a regular lattice which is closed to said planar face.

3. In a kit, one of the confectionery boards as claimed in claim 1, in which said mating members comprise a series of regularly spaced projections which project outwardly from said lower surface.

4. In a kit, one of the confectionery boards as claimed in claim 1, in which a central portion of the board is provided with a removable portion having a substantially planar upper face and opposed thereto on said lower face a projection which serves as a cake spike.

5. A confectionery board as claimed in claim 3, in which the center of the board is provided with an aperture through which a tube holding system can be fitted.

6. In a kit, one of the confectionery boards as claimed in claim 1, in which said upper surface is smooth.

7. In a kit, one of the confectionery boards as claimed in claim 1, in which said upper surface is textured.

8. In a kit, one of the confectionery boards as claimed in claim 1, in which said side surround is provided with a pair of recesses which serve as handle portions.

9. In a kit, one of the confectionery boards as claimed in claim 1, which is made from plastics.

10. A confectionery board as claimed in claim 9, in which said plastics is selected from the group comprising polypropylene and polystyrene.

11. In a kit, one of the confectionery boards as claimed in claim 9 or 10, in which the board is injection moulded.

12. A kit of parts for producing a wedding tier comprising a plurality of confectionery boards as claimed in claim 1, and at least one connecting member.

13. A kit of parts as claimed in claim 12, in which at least one connecting member comprises a pillar having integrally formed thereon a mating member adapted to engage with said mating member of the confectionery board.

14. A kit for producing a wedding tier, comprising:

a plurality of confectionery boards each including upper and lower surfaces connected by a side surround, said upper surface comprising a substantially planar face adapted to receive a cake, and opposed thereto is said lower surface which has provided thereon a plurality of mating members which are closed to said planar face, which mating members serve to engage directly or indirectly a cake pillar to enable said board and cake to be accurately positioned relative to one another;

at least one connecting member including a pillar having integrally formed thereon a mating member adapted to engage with said mating member of one of the confectionery boards; and wherein at least one connecting member includes a dowel, and wherein the pillar includes an aperture passing therethrough.

* * * * *